United States Patent [19]

Woods et al.

[11] 4,451,335

[45] May 29, 1984

[54] METHOD FOR PRODUCING FULL COLOR IMAGES ON ALUMINUM

[76] Inventors: Jack L. Woods, 1517 9th St.; Craig P. Woods, 548 Simeron; Richard L. Woods, 1517 9th St., all of Ogden, Utah 84404

[21] Appl. No.: 461,220

[22] Filed: Jan. 26, 1983

Related U.S. Application Data

[63] Continuation of Ser. No. 209,526, Nov. 24, 1980, abandoned.

[51] Int. Cl.[3] ..... C25D 11/18

[52] U.S. Cl. ..... 204/35 N; 8/471; 204/18.1; 204/38 A

[58] Field of Search ..... 204/35 N, 38 A, 18.1; 8/471; 101/470

[56] References Cited

U.S. PATENT DOCUMENTS

| | | | |
|---|---|---|---|
| 3,484,342 | 12/1969 | Blake et al. | 204/18 |
| 3,524,799 | 8/1970 | Dale | 204/58 |
| 4,180,443 | 12/1979 | Darrow | 204/35 N |
| 4,201,821 | 5/1980 | Fromson et al. | 428/203 |

OTHER PUBLICATIONS

F. A. Lowenheim, *Electroplating,* McGraw-Hill Book Co., New York, 1978, pp. 455–458, 474–475.

*Primary Examiner*—G. L. Kaplan
*Assistant Examiner*—William Leader
*Attorney, Agent, or Firm*—Thorpe, North & Western

[57] ABSTRACT

A process for the production of full color, partial colored or two colored pictures, scenes, words, etc., on articles of aluminum or aluminum alloys. The process involves first forming a hard, dense, non-colored anodic coating of between about 0.4 mils and 1.0 mils on aluminum or aluminum base alloys by anodizing the aluminum in an acidic aqueous electrolyte comprising sulfuric acid, a polyhydric alcohol of from 3 to 6 carbon atoms and an organic carboxylic acid containing at least one reactive group in the alpha position; and coloring the coating by intimately contacting the unsealed coating with a paper containing a dye or dyes capable of subliming and then heating the surfaces causing the dye to sublime and transfer to the unsealed anodic film.

8 Claims, No Drawings

METHOD FOR PRODUCING FULL COLOR IMAGES ON ALUMINUM

This is a continuation of application Ser. No. 209,526 filed on Nov. 24, 1980, now abandoned.

BRIEF DESCRIPTION OF THE INVENTION

1. Field of the Invention

This invention relates to a process for the production of partial or full color images, pictures, scenes or the like on articles of aluminum or aluminum alloys which have been previously specially anodized in order to obtain products which are useful for all types of industrial, commercial and consumer use. The products include decorative panels, nameplates, belt buckles, instrument panels, trophy articles, and others.

2. Prior Art

Many attempts have been made to economically produce multicolor images on aluminum. For example, U.S. Pat. No. 3,264,158 describes a process wherein oil soluble dyes are applied to a decal and an unsealed, anodized surface is then wetted with a solvent to cause dissolved dye to stain the surface. U.S. Pat. No. 3,258,381 describes a similar process. U.S. Pat. No. 3,218,243 discloses a method wherein water-soluble dyes are used. U.S. Pat. No. 3,242,037 describes yet another process using a dye film on a solvent wetted anodic surface. Another U.S. Pat. No. 3,193,416, discloses a vat dye and compatible solvents. Another approach was taken in U.S. Pat. No. 3,515,598 wherein a silk screening type ink is utilized for screen printing dyes onto an anodized surface. A system for coloring an anodized surface was disclosed in U.S. Pat. No. 3,718,548 wherein a meltable organic coloring matter is brought in contact with an anodized surface and is then melted into the oxide pores. Finally, U.S. Pat. No. 3,079,309 discloses a system wherein a water base ink is manufactured using water soluble dyes and pigments. This is applied to an oxide surface wherein the surface is stained. None of these prior art patents disclose a process capable of producing crisp, sharp images, or of producing pictures on a mass production basis, or of producing images having adequate clarity or durability. In addition, the processes of these prior art patents are cumbersome to practice and are not capable of producing durable, full color photographs on aluminum which are comparable to those taken by a quality camera and printed on photographic paper.

U.S. Pat. No. 3,363,557 discloses a heat transfer of indicia containing sublimable coloring agent. This process of this patent is particularly directed to printing inks for textile coloring and those inks, in accordance with the invention, comprise an organic resinous binder which when deposited supplies a dry solid film which remains solid and dry upon exposure to elevated temperatures. This patent is directed to and provides great detail about using sublimation type transfers for coloring cellulose and other organic materials used in the textile, carpet, plastic and garment industries. The patent gives several examples, each of which is concerned with placing images on textiles. In addition, the patent mentions that images can be provided on "metallic surfaces especially anodized aluminum". While the patent is clearly principally directed to the coloring of organic materials and the process disclosed will not provide any image on most metallic surfaces, it is disclosed that an image can be formed on an unsealed, anodized surface. However, unless the anodic coating is of a very specific type, not disclosed in the patent, the image produced is fugitive, subject to fading and of limited or no commercial value. Attempts over the past few years to use the standard commercial anodizing processes, which are in general practice throughout the world, have resulted in colored products which at first appeared satisfactory but later, through natural weathering and exposure to sunlight, proved valueless. The coatings produced by the heat transfers evaporated (resublimed) or were destroyed by the natural or artificial ultra violet radiation.

We have now discovered that the use of a special anodizing technique produced a superior, extremely dense and hard anodic coating optimally suited to application of single or multiple colors by transfers produced as described in U.S. Pat. No. 3,363,557. It has been found that the anodizing system disclosed in U.S. Pat. No. 3,524,799 can be modified to produce an ideal surface for subsequent coloring. This patented anodizing system was developed for producing a white surface on space vehicles and was not intended to receive coloring. In fact, the stark white surface was absolutely required to reflect heat encountered by space vehicles and rockets.

SUMMARY OF THE INVENTION

According to the present invention, a novel process is disclosed for the production of full color, partial color, or any mixture of colors on aluminum or aluminum alloys. This includes but is not restricted to full color pictures, designs, images, and the like. The anodizing is carried out in a sulfuric acid electrolyte containing a polyhydric alcohol of 3 to 6 carbon atoms and an organic carboxylic acid containing at least one reactive group in the alpha-position. The preferred polyhydric alcohol is glycerine and the preferred carboxylic acid is hydroxy acetic acid. Anodizing is carried out with a current density of about 30 amps per square foot, with sufficient anodizing time to produce an anodic film thickness of between about 0.4 and 1.0 mils. The anodically formed aluminum oxide is then carefully washed to remove the electrolyte and is allowed to air dry. During the drying operation, care must be taken to keep the surface clean so that the pores in the anodic film will remain open. A heat transfer sheet, previously prepared by printing or hand painting using colorants which are capable of subliming when heated, is placed on the unsealed film and heated at about 325° to 425° F. during which time the image from the sheet is transferred into the pores of the anodic film is vivid detail. The completed rendering is then sealed.

DETAILED DESCRIPTION

In Order to obtain a durable and desirable colorless hard anodic coating with its peculiar pore structure, it is absolutely critical that the anodic layer be maintained between 0.4 and 1.0 mils and that it be formed at a current density of between about 20 and 40 amps per square foot, with the optimum current density being 30 amps per square foot and the optimum film thickness being 0.6 mils. Further, the anodizing electrolyte must be maintained at a temperature of between 60° and 75° F. with the optimum being 70° F. and its chemistry as disclosed in Table 1.

TABLE 1

| | Minimum | Optimum | Maximum |
|---|---|---|---|
| Sulfuric Acid | 165 grams/liter | 200 g/l | 250 g/l |
| Hydroxy Acetic Acid | 10 milliliters/liter | 20 ml/l | 30 ml/l |
| Glycerine | 10 milliliters/liter | 20 ml/l | 30 ml/l |

It should be noted that the electrolyte of Table 1 is similar to that disclosed in U.S. Pat. No. 3,524,799, but without any titanic acid salt being included. It has been found that the titanic acid salt acts as a pigment resulting in some pore closure in the anodic film and a non-desirable surface for accepting the sublimation dyes from the heat transfer.

The transfers may be printed on any suitable substrate material, with paper being preferred and inks used for the preparation of transfers for the textile industry, such as are disclosed in U.S. Pat. No. 3,363,557 are acceptable. The transfers may be printed by means of offset or gravure printing, for example. Also, transfers can be hand painted using these inks and the rendering so painted can then be transferred to aluminum in accordance with the present invention. Other printing or screening methods may also be used to produce the transfers.

To illustrate this unique and novel technology and to also compare it with valueless technology, the following examples are provided:

EXAMPLE 1

Heat transfers were produced by offset printing using color separations made from a 35 millimeter slide of a lion taken in a jungle. The full color picture was printed on standard quality printing paper of size about 2½ inches by 4½ inches. The sublimation printing ink used was made by Colonial Printing Ink Company of New Jersey who manufactures this type ink for making heat transfers for the garment and carpet industry. A transfer was placed tightly against a clean, steel surface and the surface was heated to 375° F. and maintained at 375° F. for 2 minutes. No image was formed on the steel.

EXAMPLE 2

The procedure was repeated as discussed in example 1 with the transfer being placed tightly against clean metallic surfaces of tin, nickel chromium, zinc and anodized aluminum as used in the architectural and building industry. No image was formed on any of these metallic surfaces even when the time of contact and the temperature of contact were varied. It appears images were not formed on the metallic surfaces because there were no pores available to accept the dye as it sublimed from the printed paper. Consequently, the dye just evaporated into the air.

EXAMPLE 3

Anodized aluminum pieces of size 3 inches by 5 inches were produced in a standard sulfuric acid electrolyte conventionally used throughout the world. This electrolyte is normally 175 grams per liter sulfuric acid maintained at 72° F. Anodizing is carried out at a current density of about 12 amps per square foot. More detail of the process is described in the Metal Finishing Guidebook and Directory published by Metals and Plastics Publications, Inc., Hackensack, N.J. An anodic film of a thickness of 0.6 mils was produced by anodizing in the conventional electrolyte at 12 amps per square foot for 35 minutes. The aluminum pieces were rinsed free of electrolyte with tap water and allowed to air dry. Care was taken not to touch or dirty the surface. Lion picture heat transfers produced as described in example 1 were placed in intimate contact with the anodized surfaces and were heated to 375° F. The temperature was maintained for 2 minutes. The heat transfers were immediately removed and perfect images of the lion were faithfully reproduced on the unsealed anodized surface; the colors apparently having penetrated at least partially into the pores of the anodic film. These samples were then further processed as follows:

Piece A was left, as decorated, in normal room light. After 3 months, the image was apparently lighter. After 6 months, the image was approximately half vivid and after one year the lion could hardly be discerned and the green jungle grass background was completely faded out.

Piece B was placed in 190° F. water as used by some anodizers to seal anodic surfaces. After 15 minutes, the piece was removed and the lion picture was observed. It was practically bleached out and the picture was unacceptable for any practical use.

Piece C was placed in a closed steam chamber, similar to those commonly used for steam sealing of anodic coatings. Saturated steam was formed in the chamber and the piece was sealed for 15 minutes. The picture of the lion, while not greatly faded, was streaked by dye which had run from the anodic film pores. The picture was worthless.

Piece D was sealed in a water solution of nickel acetate at a temperature of 200° F. and a concentration of 5 grams per liter. Time of sealing was 15 minutes, in accordance with standard practices in the anodizing industry. The lion picture was apparently as bright as it was prior to sealing but the surface of the picture had a slight velvet-like coating. This was easily removed by rubbing with a cloth. The image appeared satisfactory. Several other samples were prepared in this manner and were tested as follows:

1. A sample was placed on a roof with a southern exposure. The image on the sample was noticeably faded in 5 days, and almost completely faded in 30 days. The picture was therefore unacceptable for commercial or decorative use.

2. Samples were made into belt buckles that were worn by adults and youth. Periodically, during an 18 month time period, they were observed. The surface on all of the buckles was seriously scratched and light to heavy fading of the image was noted.

It is apparent from the above tests that the standard sulfuric acid anodizing process produces an unsatisfactory surface for coloring using sublimation dye heat transfer techniques. Further, it is also apparent that most metallic surfaces are also worthless as surfaces upon which a picture may be transferred. Based on the testing conducted, it became apparent that even conventionally anodized aluminum surfaces would not be satisfactory for use with aluminum. Hard anodizing processes including those used for engineering and industrial purposes were also considered. All known processes produced an integrally colored surface varying in color from light bronze to gray and black. These dark surfaces were obviously unsuited for decorating with bright colors, pastel shades, etc. Even non-standard, European anodizing processes which utilize oxalic acid or mixtures of oxalic acid and sulfuric acid were tried. These processes produced gray or dark surfaces unsuitable for decorating. Chromic acid anodizing was also considered and tried but it also resulted in a gray surface. Further research was made with the standard sulfuric acid anodizing processes, attempting to obtain a more dense, durable surface. It was thought that by cooling the electrolyte and increasing the current density from the normal 12 amps per square foot, a satisfactory surface might result. This was tried, but a gray surface resulted. Anodizing temperature of 68 up to 75° F. were tried with increased current density but all the anodic films produced became smutty and powdered off. The following examples are illustrative of use of the anodizing system of the invention as disclosed in Table 1.

EXAMPLE 4

Pieces of aluminum alloy 5052 were anodized at 30 amps per square foot using the electrolyte disclosed in Table 1, having a minimum concentration of chemicals. Electrolyte temperature was 68° F. and the anodic film was 0.4 mils thick. The lion was heat transferred to the clean air dried anodic film at a temperature of 375° F. for 1 minute by holding the transfer in contact with the anodic film using a hand flat iron. An almost perfect copy of the lion resulted. Its colors were just a shade light.

EXAMPLE 5

An aluminum sample, decorated with the lion was prepared as discussed in example 4 except the optimum anodizing electrolyte was used as disclosed in Table 1. The electrolyte temperature was 70° F. The anodic film thickness was 0.6 mils. The copy of the lion obtained matched the original 35 millimeter slide from which it was copied.

EXAMPLE 6

An aluminum sample was decorated as discussed in example 5, except the anodic film thickness was 1.0 mils. The lion picture was acceptable. However, it was not quite as bright as the one prepared per example 5. It is believed that the pores in the thicker anodic film are smaller because of the thicker coating and thus cannot as readily accept the vaporized dye.

EXAMPLE 7

An aluminum sample was decorated with the lion as discussed in example 4 except an electrolyte temperature of 75° F. was used and the maximum electrolyte strength was used as shown in Table 1. The anodizing current density was 40 amps per square foot, carried out long enough to produce a film thickness of 0.6 mils. A perfect picture of the lion resulted. The inventors observed that the anodic film seemed slightly softer than the previous samples when tested by drawing a metal working file across the surface.

EXAMPLE 8

An aluminum sample was decorated with the lion as per example 7, except a current density of 20 amps per square foot was used. The picture of the lion was perfect except the anodic film seemed slightly softer as tested in example 7.

EXAMPLE 9

An aluminum sample was decorated with a lion as per example 7, except that a current density of 48 amps per square foot was used. The picture of the lion was perfect except the anodic film seemed soft when tested with a file per example 7. The anodic film appeared to be on the verge of burning (chalking).

Many decorated aluminum samples of the lion were prepared as discussed in examples 4 through 9. They were accomplished on aluminum alloy 5052. Some were sealed in the nickel acetate solution per example 3, piece D. Others were left unsealed. Part of the 2½ by 4 inch lion samples were converted to belt buckles and the others left as decorated aluminum plates. These articles were then tested for 18 months. The test results are summarized in Tables 2 and 3:

TABLE 2

Decorated Samples Per Examples - Fading Observation*

| Image Treatment/Exposure | Examples 4 | 5 | 6 | 7 | 8 | 9 |
|---|---|---|---|---|---|---|
| Unsealed - inside exposure | SF | SF | SF | SF | GF | GF |
| Sealed - inside exposure | NF | NF | NF | NF | SF | SF |
| Outdoor Southern exposure - sealed | GF | SF | GF | SF | GF | GF |
| Outdoor Southern exposure - unsealed | LI | GF | GF | GF | LI | LI |
| Worn as belt buckles - sealed | NF | NF | NF | NF | SF | SF |
| Worn as belt buckles - unsealed | GF | SF | GF | GF | GF | GF |

*LI = Loss of Image
SF = Slight Fading
GF = Great Fading
NF = No Noticeable Fading

TABLE 3

Decorated Samples Per Examples - Abrasion/Scratch Resistance*

| Image Treatment/Exposure | Examples 4 | 5 | 6 | 7 | 8 | 9 |
|---|---|---|---|---|---|---|
| Worn as belt buckles - unsealed | SS | NS | NS | SS | MS | MS |
| Worn as belt buckles - sealed | SS | NS | NS | NS | SS | MS |

*NS = No appreciable scratches
SS = Slight scratches
MS = Many deep scratches and abrasions From the tests conducted, it is apparent that the limits for the anodizing electrolyte chemistry and film thickness are established for satisfactory practicing of the invention. It is evident that practicing the invention within the limits established produces highly acceptable products and is of great value while images produced by other anodizing techniques have no commercial or practical value.

The advanced technology disclosed in this specification was further evaluated by producing full-color samples of elk, aircraft, automobiles, mountain scenes, science fiction pictures, etc. Various aluminum alloys were used including 1100, 3003, 6061, 5005, and 2024. The renderings varied from a size of 2 inches by 2½ inches to 15 by 15 inches. The anodic coating film was produced in the optimum electrolyte per Table 1. A current density of 30 amps per square foot was used and anodizing time was sufficient to produce a film thickness of about 0.6 mils. The electrolyte temperature was held between 68 and 70° F. The heat transfers were produced on an offset, full color printing press using Colonial Heat transfer inks developed for the textile and carpet industries. Transfer temperature was 375° F. using a hand flat iron and also a standard heat transfer press utilized in the "T" shirt heat transfer industry. Transfer time was from 1 to 2 minutes. The optimum time was dependent on the size of the aluminum sheet and its thickness. The sheet thickness varied from 0.032 inches to 0.125 inches. The completed work was sealed by various means with results shown in Table 4, below.

TABLE 4

| Results of Sealing the Colored Image | Perfect Image | Slight Fading of Image |
|---|---|---|
| Saturated Steam - 15 min. | X | |
| 190° F. Water - 15 min. | | X |
| 5 g/l Nickel Acetate Solution - 15 min. (200° F.) | X | |

It should be noted that nickel acetate sealing is the preferred method to seal images produced by this invention.

EXAMPLE 10

An anodic film was produced on aluminum alloy 3003 in accordance with the optimum conditions described for producing the elk, aircraft, mountain scenes, etc. The clean dry film was then contacted with a hard painted landscape scene which was painted on heavy news print type paper using Colonial Heat Transfer inks. The artist mixed the colors on a palette as if they were oil paints. The paper heat transfer and the prepared aluminum sheet were placed in a "T" shirt heat transfer press at a temperature of 375° F. for 2 minutes. A perfect permanent metal scene of the previously painted rendering resulted. The color and clarity being preserved. The rendering was then sealed in the previously described nickel acetate solution for 15 minutes.

Laboratory and metallurgical work was accomplished to determine why this invention produces highly satisfactory, beautiful long lasting decorated work while a standard anodizing system is worthless. Taber abraser tests were made on film thicknesses of 0.6 mils produced on aluminum alloy 5052 by this process. The normal sulfuric acid anodizing process is used for comparison with the process disclosed in this invention because all other processes produce colored or otherwise unacceptable films. Results are depicted in Table 5.

TABLE 5

| Taber Abraser Tests* | Millgram weight loss for 3000 cycles |
|---|---|
| Sample anodized at 30 amps per square foot at 70° F. per this invention | 11.6 |
| Sample anodized at 12 amps per square foot at 70° F. standard sulfuric process | 22.9 |
| Sample anodized at 18 amps per square foot at 70° F. per this invention | 15.7 |
| Sample anodized at 48 amps per square foot at 70° F. per this invention | 16.1 |

*Details on this test method are found in Military Specification MIL-A-8625

In addition to the Taber abraser tests, the weight of the anodic films were determined by the method outlined in Military specification MIL-A-8625. The results are shown in Table 6.

TABLE 6

| Average Anodic Film Weight in Milligrams per square foot | |
|---|---|
| 30 amps per square foot anodizing per this invention | 2920 |

TABLE 6-continued

| Average Anodic Film Weight in Milligrams per square foot | |
|---|---|
| 12 amps per square foot standard sulfuric acid anodizing process | 840 |

It appears that the process of the present invention produces outstanding decorated items and that those produced by other anodizing processes are unsatisfactory. The superior anodic coating produced in accordance with the invention protects the colors, deep inside the anodic coating pores from abrasion and it is believed that this dense film also shields the colors from degradation by ultraviolet radiation coming from the sun or other sources.

Although a preferred form of our invention has been herein disclosed, it is to be understood that the present disclosure is by way of example and that variations are possible without departing from the subject matter coming within the scope of the following claims, which subject matter we regard as our invention.

We claim:

1. A method of decorationg articles of aluminum comprising the steps of anodizing said aluminum article in an aqueous acid electrolyte consisting essentially of from about 165 to 250 grams per liter sulfuric acid, from about 10 to 30 milliliters per liter of an organic carboxylic acid containing at least one reactive group in the alpha-position wherein said reactive group is a hydroxy, amino, keto or carboxyl group, and from about 10 to 30 milliliters per liter of a polyhydric alcohol of from 3 to 6 carbon atoms, with the temperature of the electrolyte being maintained at between about 60° and 75° F. and the current density being maintained at between about 18 to 48 amps per square foot so as to form an anodized layer on the surface of said aluminum article, said layer having a thickness of between about 0.4 and 1.0 mils;

placing a dry film in intimate contact with said anodized layer, said dry film containing a dye capable of subliming when heated;

heating said dry film sufficiently to cause at least a portion of said dye to sublime and condense within said anodized layer; and thereafter sealing said anodized layer on the surface of said aluminum article.

2. The process of claim 1, wherein the polyhydric alcohol is glycerine.

3. The process of claim 1, wherein the organic carboxylic acid is hydoxyacetic acid.

4. The process of claim 1, wherein the dry film which is in intimate contact with said anodized layer is heated to a temperature of from about 325° to 425° F.

5. The process of claim 1, wherein sealing of said anodized layer is done by immersing the anodized layer in a solution of nickel acetate.

6. The process of claim 1, wherein sealing of said anodized layer is done by contacting said anodized layer with saturated steam.

7. The process of claim 1, wherein sealing of said anodized layer is done by immersing said anodized layer in hot water at a temperature of about 190° F.

8. The process of claim 1, wherein the anodized layer has a weight of at least about 2,000 milligrams per square foot and exhibits a maximum taber abraser weight loss of about 17 milligrams when tested at three thousand cycles.

* * * * *